US006815382B1

(12) United States Patent
Groten et al.

(10) Patent No.: US 6,815,382 B1
(45) Date of Patent: Nov. 9, 2004

(54) BONDED-FIBER FABRIC FOR PRODUCING CLEAN-ROOM PROTECTIVE CLOTHING

(75) Inventors: Robert Groten, Sundhoffen (FR); Holger Schilling, Hemsbach (DE); Arnold Bremann, Weinheim (DE); Hartwig Von Der Mühlen, Dossenheim (DE)

(73) Assignee: Carl Freudenberg KG, Weinheim (DE)

( * ) Notice: Subject to any disclaimer, the term of this patent is extended or adjusted under 35 U.S.C. 154(b) by 107 days.

(21) Appl. No.: 10/031,970

(22) PCT Filed: Jul. 21, 2000

(86) PCT No.: PCT/EP00/07032

§ 371 (c)(1),
(2), (4) Date: May 9, 2002

(87) PCT Pub. No.: WO01/07698

PCT Pub. Date: Feb. 1, 2001

(30) Foreign Application Priority Data

Jul. 26, 1999 (DE) ..... 199 34 442

(51) Int. Cl.[7] ..... D04H 1/00; D04H 13/00; D04H 5/02

(52) U.S. Cl. ..... 442/340; 442/361; 442/408; 442/409

(58) Field of Search ..... 442/340, 361, 442/408, 409

(56) References Cited

U.S. PATENT DOCUMENTS

| | | | | | |
|---|---|---|---|---|---|
| 5,355,565 | A | | 10/1994 | Baravian | |
| 5,866,675 | A | * | 2/1999 | Ahmed et al. | 528/339 |
| 5,899,785 | A | * | 5/1999 | Groten et al. | 442/334 |
| 5,965,084 | A | | 10/1999 | Nishijima | |
| 6,090,730 | A | * | 7/2000 | Fujiwara et al. | 442/361 |

FOREIGN PATENT DOCUMENTS

| | | |
|---|---|---|
| EP | 0 624 676 | 11/1994 |
| EP | 0 814 188 | 12/1997 |
| EP | 0 933 459 | 8/1999 |
| FR | 2 749 860 | 12/1997 |
| JP | 3-294558 | 12/1991 |
| JP | 4-185793 | 7/1992 |
| JP | 10-53948 | 2/1998 |
| WO | 98/23804 | 6/1998 |

* cited by examiner

*Primary Examiner*—Arti R. Singh
*Assistant Examiner*—Christopher Pratt
(74) *Attorney, Agent, or Firm*—Kenyon & Kenyon

(57) ABSTRACT

A nonwoven fabric for manufacturing repeatedly re-usable clean-room protective clothing, made of super microfilaments having a titer of less the 0.2 dtex that are produced by water jet splitting multicomponent multisegment filaments having a titer of less than 2 dtex, the primary filaments being spun from the melt, aerodynamically stretched, laid to form a nonwoven fabric, and subjected to water-jet prebonding prior to splitting.

15 Claims, No Drawings

BONDED-FIBER FABRIC FOR PRODUCING CLEAN-ROOM PROTECTIVE CLOTHING

DESCRIPTION OF THE TECHNICAL FIELD

Protective clothing for clean rooms has the function of protecting the products produced or processed in these rooms (e.g. microelectronic parts, pharmaceuticals, optical glass fibers) from people as the "source" of the emission of interfering particles (e.g. dust particles or skin particles, bacteria).

Therefore, the most important requirement of the material for manufacturing such protective clothing is the barrier effect. The protective-clothing material must hold in particles constantly released by the human body (skin particles, hair fragments, bacteria, etc.) as well as fiber fragments detached from a textile garment worn underneath in order to prevent the clean-room air and, thus, the product from being contaminated. Naturally, the material itself may also not release any fiber fragments or other components into the clean-room air.

In addition to the necessary barrier effect, the protective-clothing material must have a high mechanical load-bearing capacity, in particular a high level of resistance to further tearing and abrasions, to minimize the danger of the formation of tears or holes due to outside influences and/or the demands of normal wear. To be able to repeatedly re-use the protective clothing, the material must also be able to undergo washing and cleaning processes customary in the field (e.g. sterilization in an autoclave) with as little damage as possible, i.e., it must be resistant to wet-mechanical wear and pilling and be sufficiently dimensionally stable.

In addition to the barrier effect and (wet) mechanical resistance, the protective-clothing material, in particular for use in clean rooms of the microelectronics industry, must have an anti-static effect, i.e., the material should not become excessively electrostatic as a result of the unavoidable friction when worn or should be able to quickly dissipate or discharge such charges. This is necessary, on the one hand, so that sensitive microelectronics components are not damaged by point-to-point discharging, and, on the other hand, so that dust particles that could accumulate on the material's surface and potentially be later re-emitted are not pulled in from the ambient air.

In addition, the protective-clothing material should also have a sufficiently high level of wearability, i.e., have a character that is as textile-like as possible with respect to drape, feel, and appearance and should be able to breathe and, if applicable, also be heat-insulating in order to prevent the wearer from sweating or freezing excessively.

BACKGROUND INFORMATION

It is known to use synthetic fibers or synthetic filaments having an ultra fine titer to manufacture clean-room protective clothing material. In this context, "ultra fine-titered" refers to fibers having a titer of less than 1 dtex, which are also referred to a "microfibers." The term "super microfibers" may also be used for microfibers having a titer of less than 0.3 dtex.

Typical protective-clothing material on the basis of microfiber or microfilament woven fabrics or microfiber or microfilament knitted fabrics is produced in a plurality of method steps. Microfibers or microfilaments are first spun from raw polymer materials. These are then further processed to form yarns, which undergo a subsequent texturing process if necessary. Finally, the actual protective-clothing material is woven from the (textured) microfiber yarns or microfilament yarns. In the web process, conductive yarns are also able to be woven in the form of a regular pattern, e.g. in stripes or checks, to achieve the required anti-static effect. The conductive yarns contain, for example, core/coat filaments having a soot-containing or graphite-containing core or coat or also metal fibers or metalloid filaments, for example. The necessary barrier function and the high (wet) mechanical load-bearing capacity are achieved by an extremely densely and regularly weaving the microfiber yarns. However, this high web density and the predominantly surface-parallel filament orientation are unfavorable with respect to the material's breath ability. There are only a few micro pores or micro channels through or via which water vapor can be transported through the woven fabric.

The problematic property combination of barrier effect and breath ability of the protective-clothing material may be achieved by using particle-tight, yet water-vapor permeable, membranes. Such "micro porous" layers may be applied to textile materials of normal density, e.g. By lamination or direct extrusion, to obtain a material having a textile character.

The manufacturing method for high-density, microfilament woven fabrics as well as for composite materials of a breathable barrier membrane and a textile entails multiple steps and is, thus, relatively time consuming. Microfiber nonwoven fabrics present an easily manufactured alternative.

Planar calendered microfilament spun bonded materials on a polyethylene basis are able to satisfy the barrier requirements and are also particularly inexpensive to manufacture. However, such materials are practically air-tight and/or water vapor-tight and have a film-like character, i.e., the wearability is minimal. Moreover, they are only insufficiently wash fast or durable during cleaning, so that their use is limited to one-way or throw-away protective clothing.

Microfiber nonwoven fabrics made from multisegment or multi core staple fibers, which are split up into individual microfibers after the web formation and a possible prebonding via a solvent or water jets, should provide significantly better wearability with a good barrier effect than the abovementioned high-calendered microfilament spun bonded materials.

European Patent 0 624 676 describes, for example, a method for using water jet splitting to manufacture a microfiber nonwoven fabric having an extremely high bulk density and, consequently, also a good barrier effect. However, this nonwoven fabric lacks softness and heat insulation properties. As a result, the use of water jet-bonded nonwoven fabrics for the (protective) clothing industry is considered to be limited. Therefore, another method that does not use the water jet technique is proposed in the indicated patent.

Deviating from the abovementioned patent, PCT Application WO 98 1 23 804 proposes first thermally heat sealing the nonwoven fabric in a point wise manner, prior to the water jet splitting. This is intended to prevent the nonwoven fabric from interlocking with the sieve band of the water-jet aggregate during the water jet splitting and from then being damaged or even destroyed when lifted. In addition, a higher degree of fiber distribution is to be achieved, thereby resulting in improved barrier and touch properties.

European Patent 97 108 364 also strives to expand the scope of application of nonwoven fabrics. The patent describes the manufacture of a nonwoven fabric from very fine filaments, the nonwoven fabric being intended to have properties similar to woven or knitted textiles. The very fine filaments having a titer of 0.005 to 2 dtex are produced via water jet splitting from melt-spun, crimped, or non-crimped multicomponent, multisegment filaments having tinters from 0.3 dtex to 10 dtex. The thus-produced nonwoven fabric can then be after treated in different ways (e.g. Via thermofixing, point calendering, etc.) to attain special working properties. The spun bonded materials produced according to this method are supposed to be particularly suitable for manufacturing articles of clothing and other textile products.

SUMMARY OF THE INVENTION

In subsequent tests, it was surprisingly determined that nonwoven fabrics produced according to abovementioned European Patent 97 108 364 are particularly suitable for manufacturing clean-room protective clothing when they are made of super microfilaments having tinters less than 0.2 dtex and are also emboss-calendered. The super microfilaments themselves are produced by water jet splitting multicomponent filaments having a titer of less than 2 dtex that were formed using the melt spinning method, aerodynamically stretched, and prebonded using water jets.

Therefore, the present invention describes a new nonwoven material as well as the method steps for producing it. The nonwoven fabric satisfies all requirements for a repeatedly re-usable clean-room protective-clothing material. It is distinguished by a high barrier effect, a high mechanical load-bearing capacity, high dimensional stability, an efficient anti-static effect, as well as a high level of wearability (breath ability and textile character). These favorable properties are retained to a sufficient extent even after multiple, customary wash or cleaning processes (up to 30 cycles). Until now, the sum of these properties was considered to be impossible for a nonwoven fabric having split super-fine filaments.

The nonwoven fabric is made of super microfilaments having tinters of less than 0.2 dtex that are produced from non-crimped primary filaments having a titer of 1.5 to 2 dtex. Bicomponent multisegment filaments of two incompatible polymers, in particular polyester and polyamide, are preferably used as the primary filaments. This combination is known, and in this respect, reference is made to EP 97 108 364. The proportion of polyester is selected to be greater than that of polyamide, preferably between 60 and 70% by weight. To achieve the necessary anti-static effect, one of the two or both polymers are provided with suitable additives that are permanently effective, i.e., not able to be washed off or out. The anti-static effect can be achieved, e.g. By mixing in soot or graphite or by admixing polymers having a strong hydrophilic character or polymers having (semi) conductive properties, while possibly adding compatibility agents. The primary bicomponent filaments have a cross-section with an orange-like multisegment structure (pie structure). Each segment alternately includes one of the incompatible, additive polymers. This filament cross-section known per se has proven to be favorable for the subsequently described production of the super microfilaments. Following the customary aerodynamic stretching, the primary filaments undergo a further stretching and, at the same time, tempering process (hot-channel stretching) in order to achieve the desired high scuff resistance and low pilling tendency of the nonwoven fabric The thus-produced primary filaments are laid down in irregular order via special aggregates onto a moving band and are subsequently prebonded, i.e., are mechanically intertwined with one another, using a conventional water jet technique. High-pressure water jets are then applied several times to both sides of the prebonded primary filament nonwoven fabric on perforated drums, the primary filaments practically completely disintegrating into their components, i.e., into the individual super microfilaments, which are simultaneously intermingled with one another in an extremely homogenous manner. This method step produces a microfiber nonwoven fabric that possesses the necessary high barrier effect as a result of its extremely irregular and intermingled fiber structure, yet is also sufficiently permeable for water vapor.

To improve the dimensional stability during washing and cleaning processes, the microfiber nonwoven fabric undergoes a hot-air thermofixation process under tension after the water jet splitting and subsequent drying. The nonwoven fabric is then emboss-calendered in a calender having a special embossing cylinder to further increase the dimensional stability and scuff resistance. The finished nonwoven fabric has a mass per unit area of 80 to 150 g/m$^2$, preferably 95 to 115 g/m$^2$.

EXAMPLE

A nonwoven fabric is first produced having a mass per unit area of 95 g/m$^2$ with a uniform thickness of bicomponent filaments consisting of 70% poly(ethylene terephthalate) and 30% poly(hexamethylene dipamide). The primary filaments have a titer of 1.6 dtex and contain 16 segments that are alternately made up of the polyester and polyamide. The melt-spun filaments are aerodynamically stretched, irregularly laid down on a band, and subjected to a water jet treatment in which the filaments are first prebonded. The prebonded nonwoven fabric is then treated using high-pressure water jets, the primary filaments being split into individual segments and the individual segments being further coiled [twisted]. The water-jet splitting is carried out several times from both sides of the nonwoven fabric. The resulting super microfilaments have an average titer of 0.1 dtex and are non-crimped. The nonwoven fabric is subsequently dried and emboss-calendered. The thus-produced nonwoven fabric has a filter efficiency of about 60% for particles >0.5 $\mu$m or of about 98% for particles >1 $\mu$m. After being washed 30 times using a standard detergent at 40° C., the filter efficiency decreases only insignificantly to about 55% for particles >0.5 $\mu$m or to about 95% for particles >1 $\mu$m.

What is claimed is:

1. A nonwoven fabric for manufacturing repeatedly reusable clean-room protective clothing, made of super microfilaments having a titer of less than 0.2 dtex that are in turn produced by water jet splitting multicomponent filaments (referred to as "primary filaments" in the following) having a titer of less than 2 dtex, the primary filaments being spun from a melt, aerodynamically stretched, directly laid to form a nonwoven fabric, and subjected to water-jet prebonding prior to splitting wherein the primary filaments represent bicomponent filaments made of two incompatible polymers, in particular a polyester and a polyamide and at least one of the polymers has an anti-static additive prior to the primary filament being spun.

2. The nonwoven fabric as recited in claim 1, wherein the primary filaments undergo an additional stretching and tempering process after the aerodynamic stretching.

3. The nonwoven fabric as recited in claim 1, wherein the polyester proportion is greater than the polyamide proportion.

4. The nonwoven fabrics as recited in claim 3, wherein the polyester proportion is between 60 and 70% by weight with respect to the total weight of the nonwoven fabric.

5. The nonwoven fabric as recited in claim 1, wherein the polyester proportion is between 60 and 70% by weight with respect to the total weight of the nonwoven fabric.

6. The nonwoven fabric as recited in claim 1, wherein the mass per unit area of the nonwoven fabric is between 80 and 150 $g/m^2$.

7. The nonwoven fabric as recited in claim 1, wherein the mass per unit area of the nonwoven fabric is between 95 and 115 $g/m^2$.

8. The nonwoven fabric as recited in claim 2, wherein the mass per unit area of the nonwoven fabric is between 80 and 150 $g/m^2$.

9. The nonwoven fabric as recited in claim 1, wherein the primary filaments have a cross section having an orange-like multisegment structure, the segments alternately containing one of the two incompatible polymers, respectively.

10. The nonwoven fabric as recited in claim 1, wherein the primary filaments are water-jet split by high-pressure water jets being alternately applied several times to both sides of the prebonded nonwoven fabric.

11. The nonwoven fabric as recited in claim 10, wherein the water jet splitting is carried out on an aggregate having rotating, perforated drums.

12. The nonwoven fabric as recited in claim 1, wherein the nonwoven fabric is emboss-calendared after being water jet split and subsequently dried.

13. The nonwoven fabric as recited in claim 1, wherein the nonwoven fabric undergoes a thermofixation and subsequent thermosetting after jet splitting.

14. The nonwoven fabric as recited in claim 1, wherein at least one two incompatible polymers contains a permanently anti-statically acting soot or graphite additive, a poly(amide-block-ether) copolymer having a pronounced hydrophilic character or a polyanaline or polyacetylene derivative polymer having (semi) conductive properties.

15. The nonwoven fabric as recited in claim 1, wherein the super microfilaments are non-crimped.

* * * * *

UNITED STATES PATENT AND TRADEMARK OFFICE

CERTIFICATE OF CORRECTION

PATENT NO. : 6,815,382 B1
DATED : November 9, 2004
INVENTOR(S) : Groten et al.

It is certified that error appears in the above-identified patent and that said Letters Patent is hereby corrected as shown below:

Column 2,
Line 21, change “By” to -- by --;

Column 3,
Lines 5, 19 and 40, change “tinters” to -- titers --; and
Line 7, change “Via” to -- via --.

Signed and Sealed this

Fourth Day of October, 2005

JON W. DUDAS
*Director of the United States Patent and Trademark Office*